US009980577B1

(12) United States Patent
Coussens

(10) Patent No.: US 9,980,577 B1
(45) Date of Patent: May 29, 2018

(54) BED SHEET SECURING APPARATUS

(71) Applicant: David Coussens, Little Rock, AR (US)

(72) Inventor: David Coussens, Little Rock, AR (US)

( * ) Notice: Subject to any disclaimer, the term of this patent is extended or adjusted under 35 U.S.C. 154(b) by 0 days. days.

(21) Appl. No.: 15/296,516

(22) Filed: Oct. 18, 2016

Related U.S. Application Data

(63) Continuation-in-part of application No. 13/311,263, filed on Dec. 5, 2011.

(51) Int. Cl.
*A47C 21/02* (2006.01)

(52) U.S. Cl.
CPC ..... *A47C 21/022* (2013.01)

(58) Field of Classification Search
CPC ..... A47C 21/022; A47C 21/028; Y10T 24/23
See application file for complete search history.

(56) References Cited

U.S. PATENT DOCUMENTS 2,223,412 A * 12/1940 Gartz ..... A47C 21/022 24/72.5
2,321,394 A * 6/1943 King ..... A47C 21/022 24/72.5
2,459,497 A * 1/1949 Calabro ..... A47C 21/022 24/72.5
4,624,022 A * 11/1986 Dolan ..... A47C 21/022 24/72.5
4,829,617 A * 5/1989 Dameron ..... A47C 21/022 24/306
5,148,560 A * 9/1992 Torres ..... A47C 21/022 24/72.5
5,467,491 A * 11/1995 Griffith ..... A47C 21/022 24/72.5
6,295,670 B1 * 10/2001 Schieberl ..... A47C 21/022 24/72.5
2007/0271704 A1 * 11/2007 Breeland ..... A47C 7/021 5/653

* cited by examiner

*Primary Examiner* — Robert Sandy
*Assistant Examiner* — Matthew J Sullivan

(57) ABSTRACT

An apparatus for holding a bed sheet, either flat or fitted, in place includes a flexible, non-elastic pad and attached strap. A clip on the end of the strap engages the corner or side of the bed sheet, and the flexible pad is slid beneath the mattress to hold the sheet in place. When force is exerted onto the pad due to pulling of the pad resulting from sheet movement, the flexible pad folds upon itself, thereby providing resistance to prevent the pad from being pulled from beneath the mattress. As the force on the pad increases the degree of folding increases, such that the pad self-adjusts to provide the necessary degree of resistance to hold the sheet in place.

16 Claims, 6 Drawing Sheets

BED SHEET SECURING APPARATUS

CROSS-REFERENCE TO RELATED APPLICATIONS

This application is a continuation-in-part of U.S. patent application Ser. No. 13/311,263, filed on Dec. 5, 2011. Such application is incorporated by reference in its entirety.

STATEMENT REGARDING FEDERALLY SPONSORED RESEARCH OR DEVELOPMENT

Not applicable.

BACKGROUND OF THE INVENTION

The invention relates to devices for securing a bed sheet in place on a mattress, and in particular to such devices designed for use with fitted or flat bed sheets.

Sheets placed over a mattress are either of the flat or fitted variety. Flat sheets, as are sometimes still used by hotels, are typically fitted to the mattress by simply tucking the sheet corners under the corresponding corner of the mattress. The corners of these sheets easily slip out from under the mattress due to movement during sleep or from entering or exiting the bed. Fitted sheets are those that are drawn up at their corners with an elastic material in order to fit snugly over the four corners of the mattress. While such sheets are more likely to stay in place during use than traditional flat sheets, they still are commonly found to release from one or more corners of the mattress over time.

The art includes a number of devices intended to solve the problem of sheet slippage. Such devices are taught, for example, in U.S. Pat. No. 2,459,497, U.S. Pat. No. 2,321,394, U.S. Pat. No. 5,148,560, and French Patent No. 2,777,167. None of these devices have proven entirely satisfactory, in that they are not sufficiently secure, unduly complicated, too costly to produce, require complete removal of the mattress to secure in place, or are visible during use. An improved means of securing either a flat or fitted sheet in place that does not suffer from these drawbacks is therefore desired.

References mentioned in this background section are not admitted to be prior art with respect to the present invention.

BRIEF SUMMARY OF THE INVENTION

The present invention is directed to a bed sheet securing apparatus that may be easily and quickly attached at one or more corners of a bed sheet, or to the sides of a flat or fitted sheet, and that will securely hold the bed sheet in place during use. The present invention is simple and inexpensive to produce, and is simple to install or use. Further, the present invention may be installed between a mattress and box-spring, or otherwise under a mattress, in a manner whereby the apparatus is not visible to the user after installation.

The device uses a flexible but non-elastic pad that is designed to move in its entirety from one location between the box spring and mattress of a bed to a secondary optimal location. In doing so, the pad resistance to movement increases until additional movement is prevented. The device pad is flexible but not elastic. Resistance to movement is increasingly created by lateral movement of the pad which creates folding (but not elastic bunching) of the leading edge of the device. Increased tension on the device strap will create additional lateral movement of the device resulting in increased folding until resistance to movement overcomes the lateral pull produced by an occupant lying on the sheet attached to the device. The folding is a result of flexibility of the pad, not elastic stretching. The pad does not return to its original position between the mattress and box spring after folding. The pad of the device does not and cannot return to its original shape without lifting the mattress. If additional tension is applied to the device such as when an additional person occupies the bed, the device will move more and will fold more, thus creating more resistance, and thus the device will self-adjust to the necessary resistance to keep the bedsheet in place.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Figure 1:
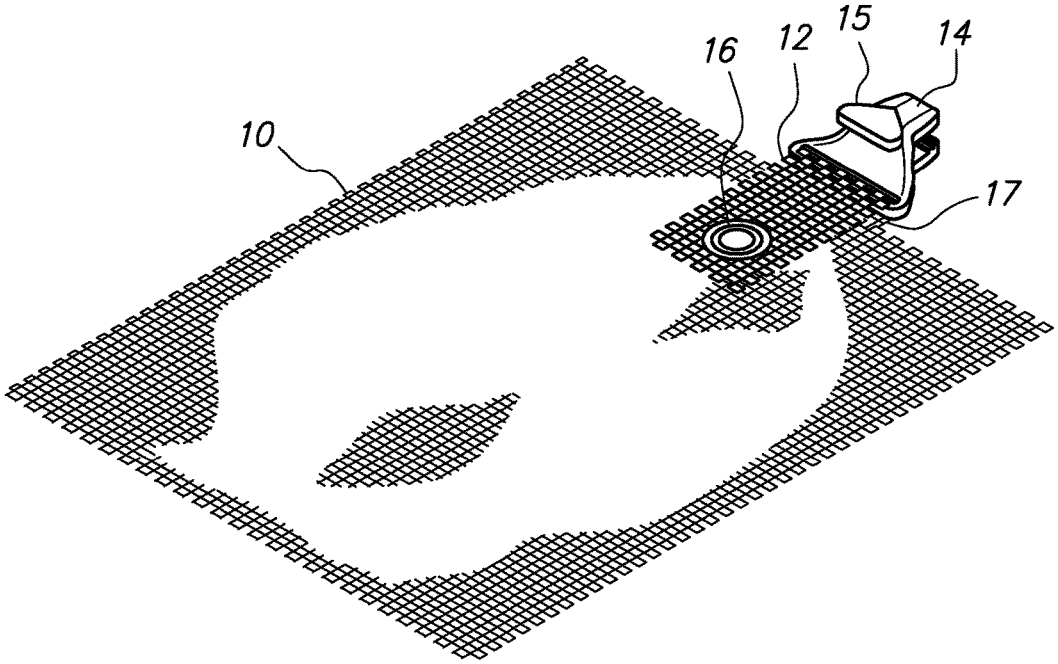
FIG. 1 is a perspective view of a first preferred embodiment of the present invention.
Figure 2:
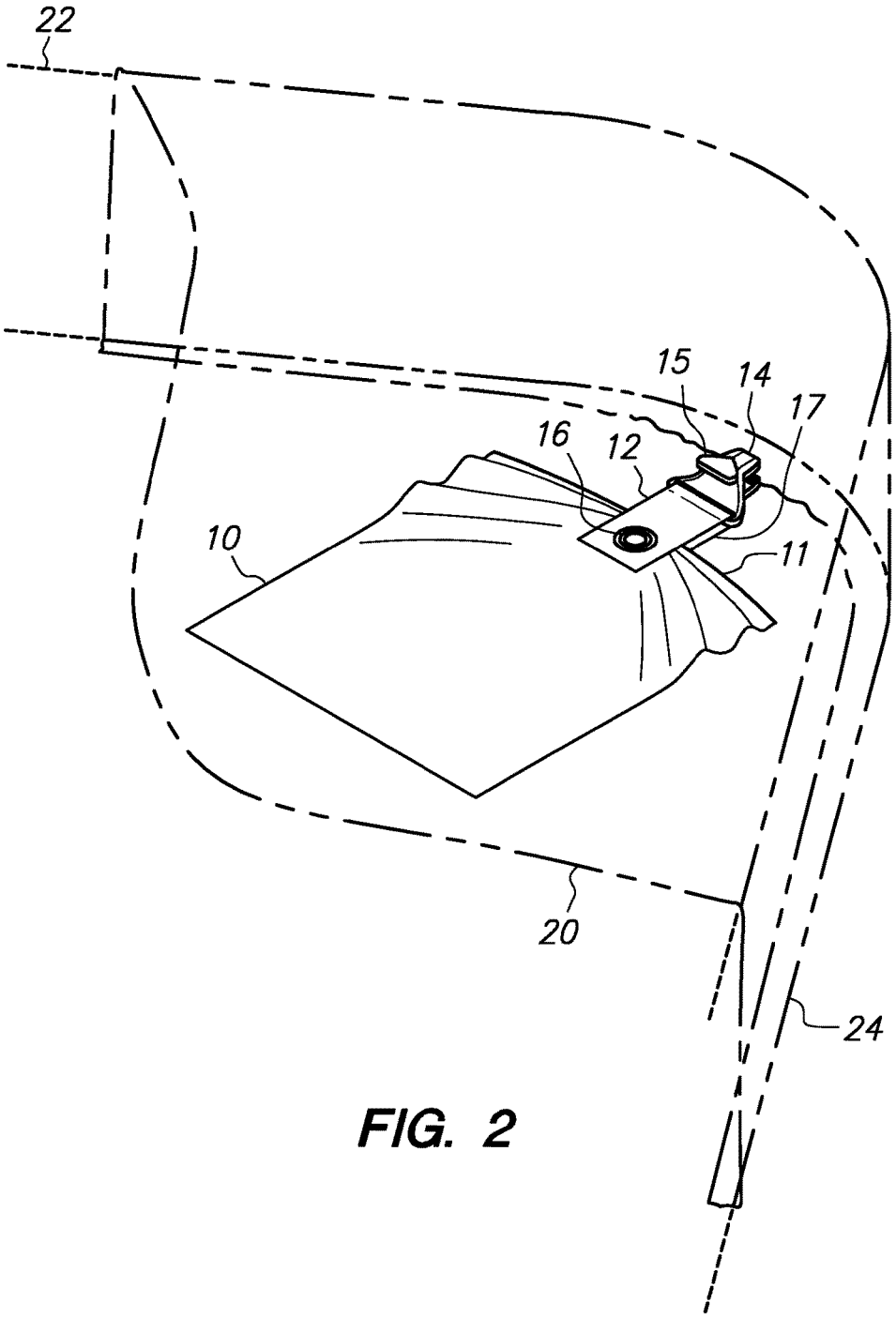
FIG. 2 is a perspective view of a first preferred embodiment of the present invention when in use, attached to a fitted bed sheet and positioned between a mattress and box-spring at the corner.
Figure 3:
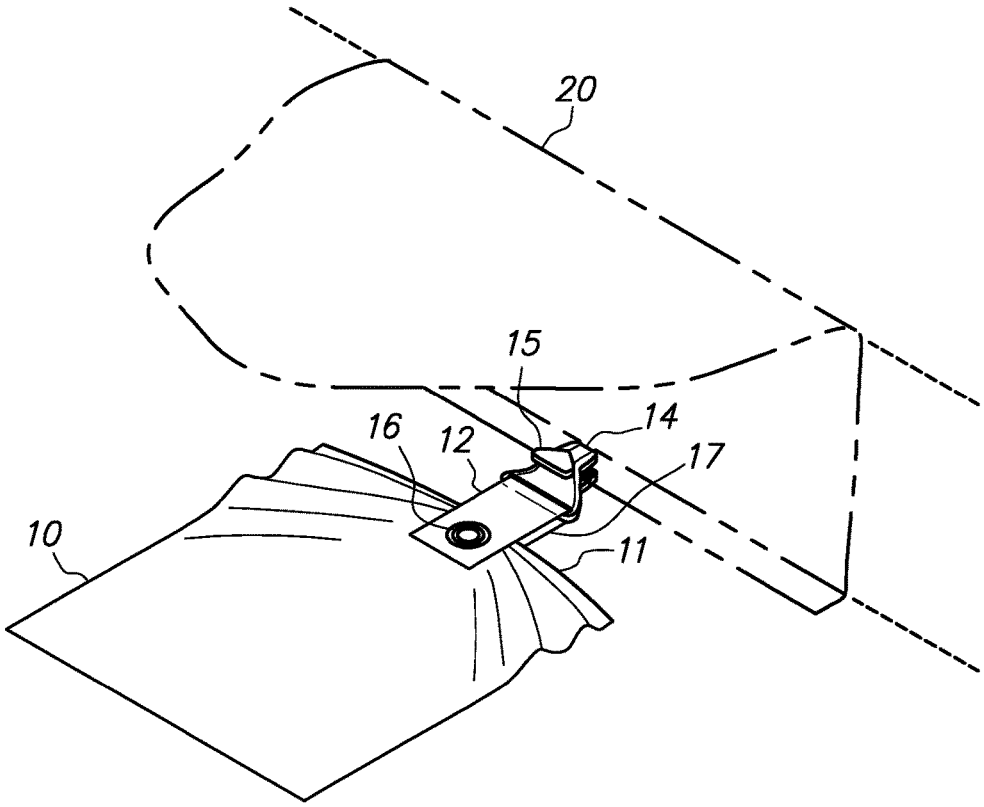
FIG. 3 is a perspective view of a first preferred embodiment of the present invention when in use, attached between a mattress and box-spring at the side of the bed.

With reference to FIGS. 1-3, a first preferred embodiment of the present invention may now be described.

The preferred embodiment includes a pad 10 that is sized to be fitted beneath at least one corner or side of a mattress 22, between the bottom of mattress 22 and the top of box-spring 24 of a traditional American-style bed. FIG. 2 shows pad 10 as connected at the corner of a bed with a fitted sheet 20, while FIG. 3 shows pad 10 connected at the side of a bed. It should be understood that the invention is adaptable for use with both fitted and flat sheets, and may be placed at the corners of a bed, at the sides, or in both locations, all of which variations are within the scope of the invention.

Pad 10 is preferably of a rectangular or square shape and relatively small size, such as a rectangle with dimensions 8"×10", but many other sizes and shapes are possible in alternative embodiments. Pad 10 is preferably formed of a material that provides a "grip" when engaged with mattress 22 and box-spring 24, thereby resisting movement. For example, pad 10 may be formed of a nylon or polyester frame or mesh with a polyvinyl chloride foam coating, which is a material commonly used for holding area rugs in place on hardwood floors. This material is flexible, but provides a significant degree of frictional force against lateral movement of the pad. The flexible but non-elastic aspect of the material is important to the function of the device in the preferred embodiments, as will be explained more fully below, because it allows the pad to fold without stretching.

A strap 12 is attached to pad 10 by means of grommet 16. In this first preferred embodiment, strap 12 is not attached to pad 10 at leading edge 11, but instead connects with pad 10 at a point behind leading edge 11, preferably leaving at least the first 1" or so of pad 10 at leading edge 11 in front of the attachment point between strap 12 and pad 10. In the preferred embodiment, strap 12 is about 1½" in width, although other sizes are within the scope of the invention in alternative embodiments. Strap 12 is preferably doubled, such that it extends over both the upper and lower surfaces of pad 10 and is attached at both ends by grommet 16 passing through pad 10. Grommet 16 is preferably formed of brass for durability, but other materials may be substituted. In alternative embodiments, strap 12 may be attached to pad 10 by other means, such as by sewing or the applicable of glues, adhesives, or staples. The strap may be constructed of the same material as pad 10, or may in alternative embodiments be other materials, such as nylon or polyester ribbon.

A clip 14 is attached to strap 12 in order to engage sheet 20. Clip 14 preferably includes lock 15 in order to hold the clip firmly in place when engaged with fitted sheet 20. In the preferred embodiment, strap 12 passes through loop 17 at the rear of clip 14 as it is doubled around pad 10. Clip 14 may be of many types as are well known in the art, such as the removable type of clips used on buttonless pants suspenders. It may be formed of, for example, acetal resin or vinyl for the advantages of strength, light weight, and relatively low manufacturing cost.

Referring now to FIGS. 2 and 3 specifically, the method of operation for the preferred embodiment may be described. Clip 14 is first attached to the appropriate corner or side of sheet 20, as appropriate, and locked in place with lock 15. Pad 10 is then slipped beneath mattress 22 and on top of box-spring 24, such that the connection between clip 14 and sheet 20 is under mattress 22. It may be noted that the invention is equally usable on beds that substitute another type of support for box-spring 24, such as rigid or flexible panels or slats as used in combination mattress/box-spring beds and cribs. Once mattress 22 is lowered into the normal position after placement of pad 10, it may be seen that the weight of mattress 22 serves to hold pad 10 in place. It will also be understood that the entire device is no longer visible to the user, thus providing a neat appearance for the bed.

When a force is acting to pull sheet 20 in a direction away from the edge at which the device is attached, it may be seen that the resulting force pulls at strap 12, thereby pulling pad 10 laterally away from its position under the corner or side of mattress 22. As this occurs, the flexible nature of the material of which pad 10 is formed causes pad 10 to move and fold upon itself. This folding of pad 10 increases the frictional connection between pad 10 and mattress 22 and box-spring 24 to its upper and lower sides, respectively. As a result, the application of this pulling force on fitted sheet 20 makes pad 10 adhere more strongly in place beneath mattress 22, thereby providing greater resistance against the tendency of this pulling force to remove the corner of fitted sheet 20 from its place around the corner of mattress 22 or for a side of a fitted or flat sheet to pull out from under the mattress.

Due to the design of the device and the resulting folding that occurs in pad 10, the size of pad 10 may be made smaller than would otherwise be required if, for example, pad 10 did not allow for this folding to occur. In the experiments conducted by the inventor hereof, a pad 10 sized to about 8"×10" and formed of a nylon or polyester frame, polyvinyl chloride coated material has been found to provide resistance sufficient to hold fitted sheet 20 in place on mattress 22 during any amount of force likely to be encountered during everyday use. By thus limiting the size of pad 10, the preferred embodiment is made easier to install, easier to store when not in use, and less expensive to manufacture.

Figure 4:
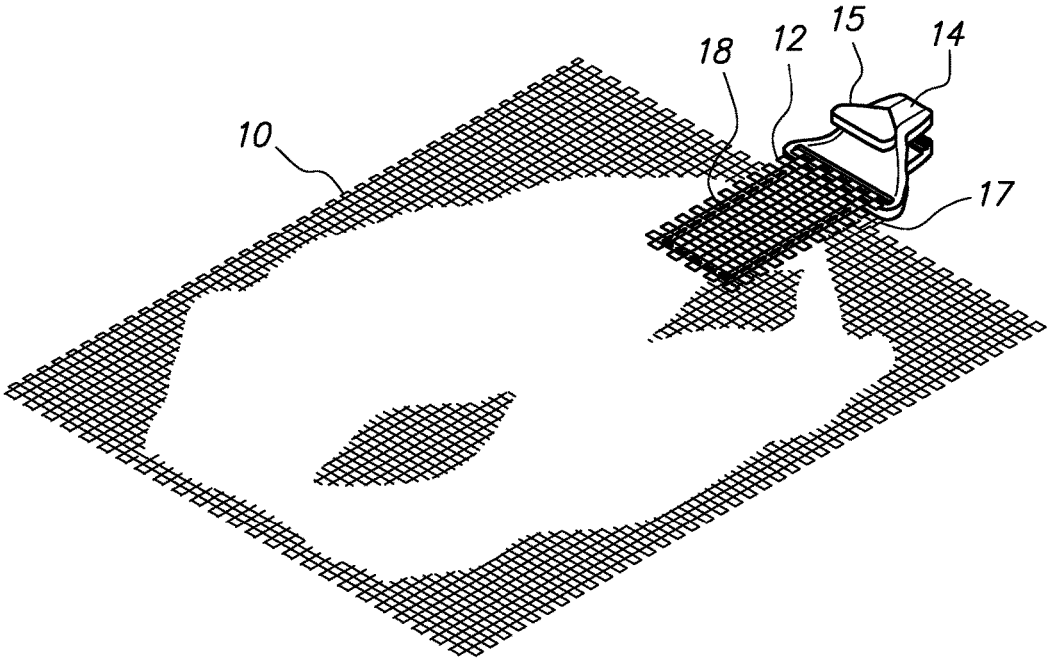
FIG. 4 is a perspective view of a second preferred embodiment of the present invention.
Figure 5:
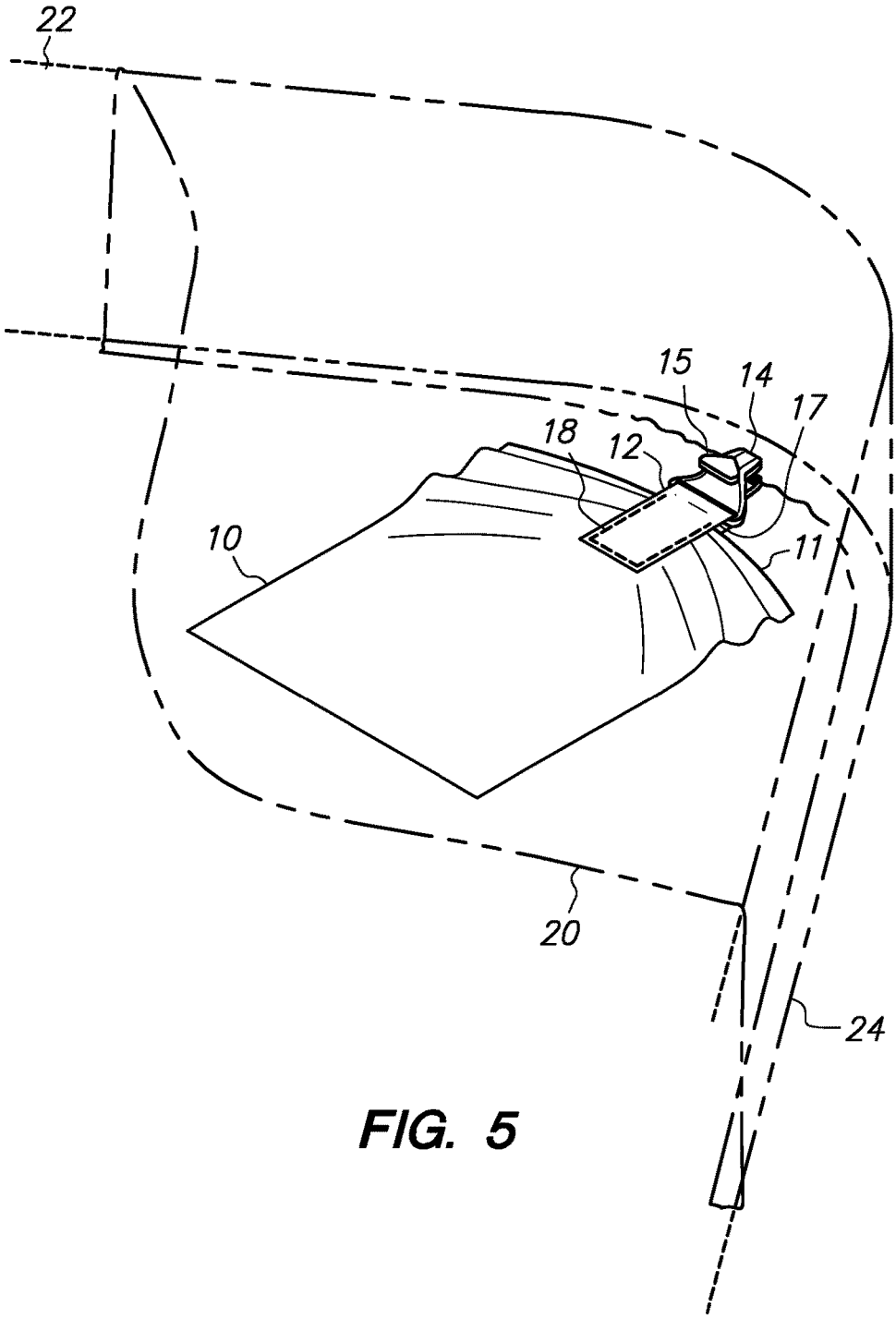
FIG. 5 is a perspective view of a second preferred embodiment of the present invention when in use, attached to a fitted bed sheet and positioned between a mattress and box-spring.
Figure 6:
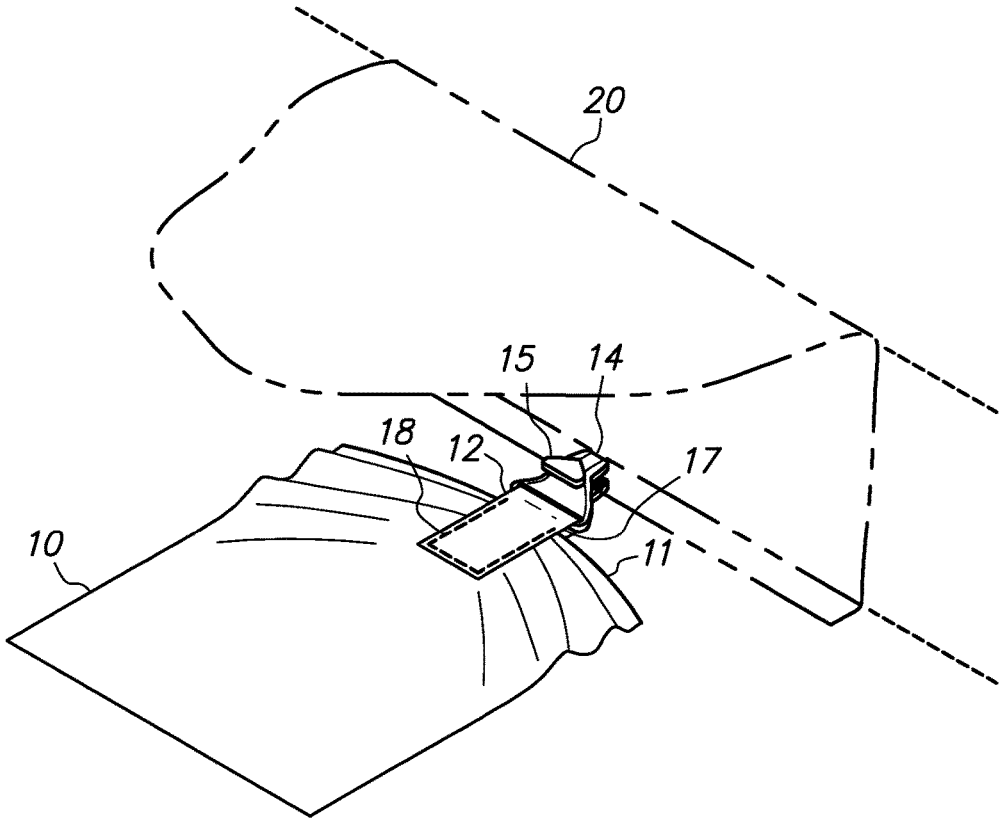
FIG. 6 is a perspective view of a second preferred embodiment of the present invention when in use, attached between a mattress and box-spring at the side of the bed.

Now with reference to FIGS. 4-6, a second preferred embodiment of the present invention may be described. It may be seen from the figures that in this second embodiment, the construction of the device is largely the same as in the first embodiment, except that grommet 16 has been replaced with sewing lines 18. In this embodiment, strap 12 is sewn to pad 10 such that strap 12 is attached to pad 10 all the way to leading edge 11 of pad 10. It may be noted that while sewing lines 18 are shown in this second preferred embodiment, other means of connecting strap 12 to pad 10 up to leading edge 11 may be employed in alternative embodiments, such as the placement of a grommet close to leading edge 11, glues or adhesives, staples, and the like.

Referring now to FIGS. 5 and 6 in describing the method of operation of the second preferred embodiment, it may be seen that a pulling force on sheet 20 will cause a resultant force at strap 12, and again this will cause movement and folding of pad 10 beneath mattress 22. In this case, however, strap 12 is connected to pad 10 all the way to leading edge 11, and thus there will be no significant folding in the region of leading edge 11 that lies underneath (or between the overlapped layers of) strap 12. Since the width of strap 12 is significantly less than the width of pad 10, however, there will be folding of pad 10 along the outer ends of leading edge 11. Thus the outer edges, particularly where they are folded along leading edge 11, will provide significant resistance to the pulling of sheet 20 away from the corner or sides of mattress 22.

The folding effect is less pronounced in the second preferred embodiment of the present invention when compared to the first preferred embodiment. The second preferred embodiment, however, offers the advantage of a connection between pad 10 and strap 12 that may be more rugged, reducing any tendency for pad 10 to tear at its connection point with strap 12. Thus while pad 10 may need to be larger in order to provide equal resistance to the pulling away of fitted sheet 20 from the corner of mattress 22, the second preferred embodiment may provide the advantage of increased length of useful life for the device, thereby lowering the effective cost of the device during use over its lifetime.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims.

In general the terms and phrases used herein have their art-recognized meaning, which can be found by reference to standard texts, journal references and contexts known to those skilled in the art. The preceding definitions are provided to clarify their specific use in the context of the invention. All ranges stated herein are intended to include all sub-ranges within the range and all discrete points within the range.

All patents and publications mentioned in the specification are indicative of the levels of skill of those skilled in the art to which the invention pertains. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention as set forth in the appended claims.

The invention claimed is:

1. A bed sheet securing apparatus, comprising:

a. a flexible, non-elastic pad adapted to fit underneath a mattress wherein the pad comprises a flexible but non-elastic nylon or polyester mesh and a polyvinyl chloride coating on the mesh;

b. a non-elastic strap comprising a proximal end and a distal end, the proximal end of the strap being attached to an attachment side of the pad; and c. a clip attached to the distal end of the strap and adapted to engage a perimeter of a sheet covering the mattress;

wherein the pad is flexible such that lateral movement of the pad in the direction of the clip resulting from a pulling force at the clip causes the entire pad to move toward the clip and the attachment side of the pad to move toward the clip and fold, thereby increasing the resistance of the pad to further movement as the pad folds more until movement of the pad stops and thus holding the sheet in place on the mattress.

2. The bed sheet securing apparatus of claim 1, wherein the attachment side of the pad comprising a leading edge, and the strap is attached to the pad behind the leading edge of the attachment side of the pad.

3. The bed sheet securing apparatus of claim 2, wherein a grommet secures the strap to the pad.

4. The bed sheet securing apparatus of claim 3, wherein the grommet is positioned at least one inch away from the leading edge of the attachment side of the pad.

5. The bed sheet securing apparatus of claim 2, wherein the strap is sewn to the pad.

6. The bed sheet securing apparatus of claim 1, wherein the strap comprises a non-elastic nylon or polyester frame and a polyvinyl chloride coating on the frame.

7. The bed sheet securing apparatus of claim 1, wherein the strap comprises a non-elastic polyester or nylon ribbon.

8. The bed sheet securing apparatus of claim 2, wherein the pad comprises a top and bottom surface, and the strap is doubled around the pad and attached at both the top and bottom surfaces.

9. The bed sheet securing apparatus of claim 1, wherein the attachment side of the pad comprising a leading edge, and the strap is attached to the pad at the leading edge of the attachment side of the pad.

10. The bed sheet securing apparatus of claim 9, wherein the strap is sewn to the pad.

11. The bed sheet securing apparatus of claim 10, wherein the strap comprises a non-elastic nylon or polyester frame and a polyvinyl chloride coating on the frame.

12. The bed sheet securing apparatus of claim 10, wherein the strap comprises a non-elastic polyester or nylon ribbon.

13. The bed sheet securing apparatus of claim 9, wherein the pad comprises a top and bottom surface, and the strap is doubled around the pad and attached at both the top and bottom surfaces.

14. A variable-resistance sheet anchoring device, comprising:

a. a non-elastic, flexible pad comprising a leading edge wherein the pad comprises a flexible but non-elastic nylon or polyester mesh and a polyvinyl chloride coating on the mesh;

b. a non-elastic, flexible strap attached to the pad; and c. a clip attached to the strap and adapted to engage the sheet on a mattress;

wherein the pad is flexible such that a force applied at the strap due to movement of the sheet causes the entire pad to move and the leading edge of the pad to fold upon itself until resistance stops the movement of the pad and the sheet attached to the clip is held in place, further wherein if an additional force is added to the strap additional movement of the pad will occur and the degree of folding of the leading edge will increase to counter an increase in the force applied at the strap and thus the pad is maintained beneath the mattress and the attached sheet.

15. The variable-resistance sheet anchoring device of claim 14, wherein the strap is attached to the pad behind the leading edge of the pad.

16. The variable-resistance sheet anchoring device of claim 14, wherein the strap is attached to the pad at the leading edge of the pad.

* * * * *